United States Patent [19]

Hanger

[11] 4,210,404

[45] Jul. 1, 1980

[54] PRINTHEAD COMPENSATION ARRANGEMENT FOR PRINTER

[75] Inventor: William A. Hanger, Churchville, Va.

[73] Assignee: General Electric Company, Waynesboro, Va.

[21] Appl. No.: 847,569

[22] Filed: Nov. 1, 1977

[51] Int. Cl.[2] ..... B41J 3/12; B41J 19/32

[52] U.S. Cl. ..... 400/124; 400/306; 400/328

[58] Field of Search ..... 400/124, 320, 328, 303, 400/305, 306, 121

[56] References Cited

U.S. PATENT DOCUMENTS

| | | | |
|---|---|---|---|
| 3,942,619 | 3/1976 | Nordstrom et al. | 400/124 |
| 3,973,662 | 8/1976 | Fulton | 400/124 |
| 4,020,939 | 5/1977 | Quaif et al. | 400/124 |
| 4,024,941 | 5/1977 | Sekikawa et al. | 400/124 |
| 4,049,108 | 9/1977 | Giessner | 400/124 |
| 4,116,567 | 9/1978 | San Pietro | 400/124 |

FOREIGN PATENT DOCUMENTS

| | | | |
|---|---|---|---|
| 2516835 | 10/1976 | Fed. Rep. of Germany | 400/124 |

*Primary Examiner*—Paul T. Sewell
*Attorney, Agent, or Firm*—Michael Masnik

[57] ABSTRACT

An impact printer is described having a control circuit for varying the location at which the printing elements of a printhead are actuated in order to compensate for flight time of the elements and other mechanical characteristics of the printer.

27 Claims, 5 Drawing Figures

10
12
14
16
18
19
20
21
22
23
24
25
26
28
30
34
37
50
52
54
56
58
60
62
64
66
68
70
72
74
76
78
80
82
84
86
88
90
92
94
96
98
100
102
104

PRINTHEAD COMPENSATION ARRANGEMENT FOR PRINTER

BACKGROUND OF THE INVENTION

This invention relates to printing devices. The invention relates more particularly to a means for compensating for printing element flight time and other printer variations which result in columnar misregistration in printers.

In one form of relatively highspeed printing device, a character print head is transported parallel to a stationary platen and its printing elements are selectively activated in a transverse direction toward the platen. The printing elements impact a printing ribbon and a medium which are positioned between the platen and the moving head and forms characters on the medium.

One form of relatively highspeed printer comprises a dot matrix printer. In dot matrix printing, a character is formed by a plurality of printed dots which are selected from a rectangular array or matrix of dot locations arranged in columns and rows. The printing head in a dot matrix printer includes a plurality of individually selectable printing elements or wires which are aligned vertically to form one or more of the dots of a matrix column. These printing wires are accelerated toward the platen by associated solenoids. Scanning of the head along the platen results in the successive columnar printing of additional dots necessary to form the character.

An important consideration in the reproduction of printed characters, particularly when a large quantity of data is being printed, is vertical alignment or registration between characters which extend in a column over a number of horizontally printed lines. Columnar misregistration is undesirable since it detracts from the overall appearance of the printed material. Furthermore, when printing on vertically ruled forms such as may be used for accounting and business purposes, columnar misregistration can result in overlapping of the printed character on a ruled line and obliterate the character or confuse the reader. In dot matrix printing in particular, the overlapping of a character and a vertically ruled line can in some instances result in the alteration of the character.

High speed printers have, at times, exhibited this undesirable columnar misregistration. During the formation of a character by high speed impact printing, each of the printing elements which is advanced along the platen and which has a finite mass exhibits a delay or flight time between a time at which the printing element is initially actuated and a time at which it impacts the print medium to form a character. Since each of the printing elements are moving parallel to the platen, the character will be printed at a location displaced from the point of initial actuation. In dot matrix printers, for example, the printing wires each have a finite mass which incur a delay time between the time when a solenoid energization is initiated and the time a dot is actually formed. The printer includes means for locating the head and for establishing printing locations along the platen. Printing wire flight time results in a divergence or flight time displacement between the print location called for by the printer and the actual position of the printed character.

Highspeed printers often provide for incremental or stepwise printing and for continuous printing. In incremental printing the printing head which is controlled from a keyboard or from a communication line is stepped to a plurality of successively located printing positions at which the character or dot matrix column is printed. During continuous printing the head is maintained in continuous motion and printing occurs while the head is being advanced. The lack of columnation over successive lines often becomes apparent when the printer is operated in an incremental mode and particularly when the input characters are selected from a keyboard. During incremental printing, a flight distance displacement of the printed dots is encountered in the course of each acceleration to, or deceleration from maximum printing velocity. The flight time displacement during acceleration or deceleration can occur over a distance of one to three characters. While in a continuous printing mode, the flight time displacement is not as severe, none the less the highspeed printing technique of printing successive lines in alternately different directions results in a doubling of the lack of columnation which can become apparent.

In addition to the referred-to flight time displacements of the printed dots, other mechanical characteristics of the device contribute to an undesired lack of columnation in the printout. These characteristics include a mechanical cocking of the printhead and the existence of a spring factor in the head drive system. The printhead is generally supported and transported on a track such as, for example, an elongated machined rod which extends in a direction parallel to the platen. In a dot matrix printer, the printhead includes a printhead body which is also accurately machined for transport along the rod. A mechanical tolerance is provided between the track and the transported head to enable binding free start-stop movements. This tolerance permits a cocking or tilting of the printhead on the track when inertial forces occur as the head is being accelerated or decelerated along the track. The cocking is developed between the head and the track and albeit relatively small, it occurs in a direction opposite to the accelerating force and causes a delay in the head movement which contributes to displacement of the printhead character.

In some highspeed printer arrangements, the printhead is accelerated along the track by a drive means which exhibits a spring factor or action. The spring action results in a delay and displacement of the printed character. A spring action occurs, for example, with a drive mechanism utilizing an elastomeric belt.

The flight time, cocking and spring factor displacements both individually and cumulatively contribute to an increased columnar misregistration.

Accordingly, it is an object of this invention to provide an improved printer.

Another object of the invention is to provide an improved printer having means for reducing columnar misregistration.

Another object of the invention is to provide an impact printer having means for compensating for printer characteristics which result in a displacement of printed characters.

Another object of the invention is to provide an improved printer having means for compensating printing element flight time displacement in a printing head.

A further object of the invention is to provide an improved impact printer having means for compensating for printer character displacement resulting from mechanical cocking of the printhead.

Another object of the invention is to provide an improved impact printer having means for compensating for printed character displacement resulting from a spring action characteristic of a print head transport drive.

SUMMARY OF THE INVENTION

In accordance with features of this invention a printer is provided having a print head for printing characters and an elongated printing platen. A transport means advances the print head means in a direction substantially parallel to a longitudinal axis of the platen. Actuating means are provided for accelerating the printing elements of the print head in a transverse direction toward the platen at predetermined print positions. Circuit means are provided for varying the location of initiation of the activation of the printing elements in order to compensate for displacement of the printhead elements from the predetermined print positions which can occur as a result of flight time of the printhead elements and other mechanical characteristics of the printer.

In accordance with other features of the invention, means including a source of electrical signal and a counter are provided for establishing a plurality of counts representative of successively positioned, predetermined matrix column printing positions along the platen. Circuit means are provided for sensing movement of the head printing means and for varying the predetermined count in accordance with the movement of the head printing means. The latter circuit means provide for varying the predetermined count to compensate for displacement occurring as a result of flight time of the printing elements and other mechanical characteristics of the printer.

BRIEF DESCRIPTION OF THE DRAWINGS

These and other objects and features of the invention will become apparent with reference to the following specification and to the drawings wherein.

DETAILED DESCRIPTION

Figures 1, 3:
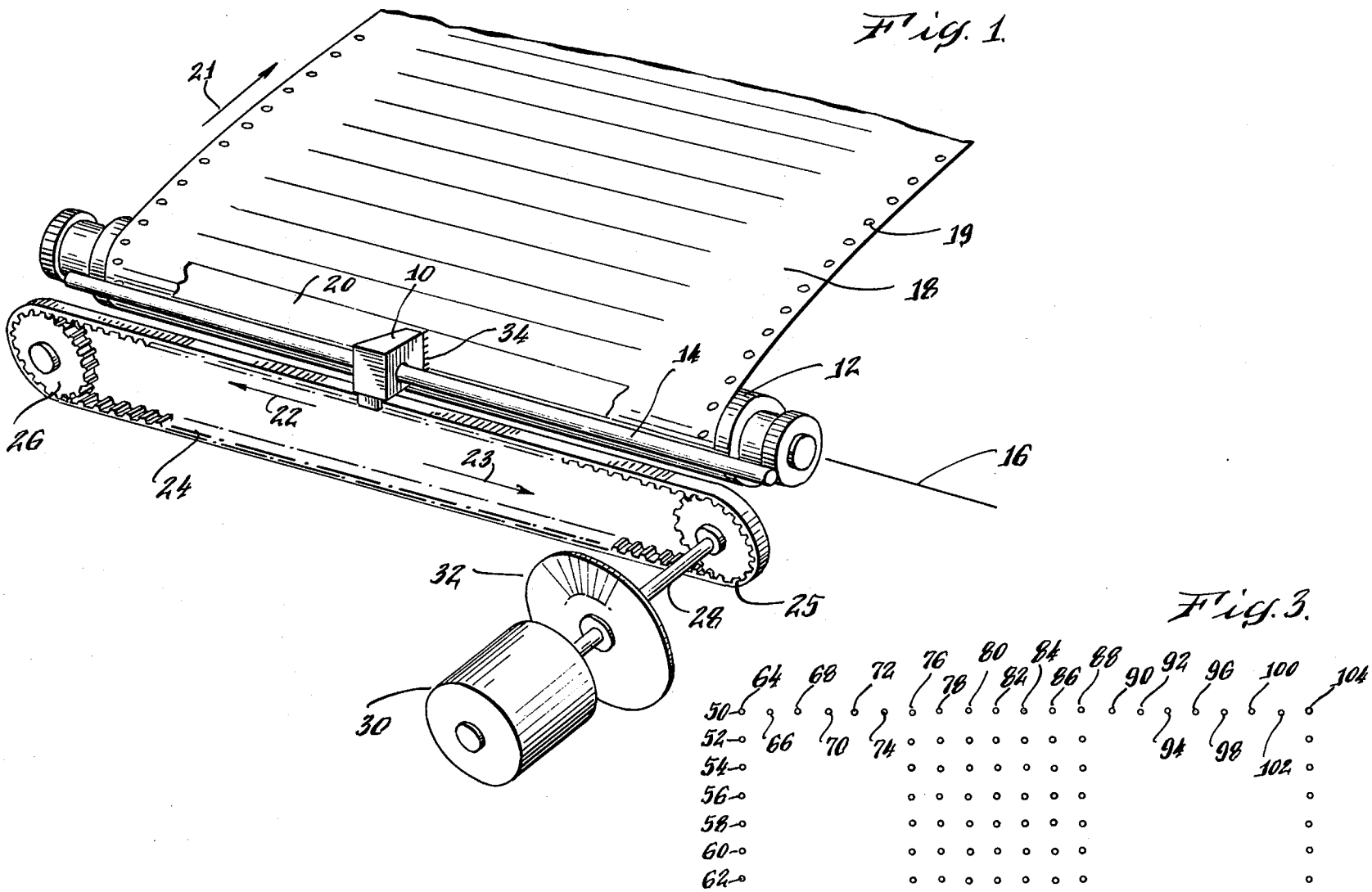
FIG. 1 is a fragmentary perspective view of an impact printer constructed in accordance with features of this invention.
FIG. 3 is a diagram illustrating a rectangular, dot-matrix array.

Referring now to FIG. 1, an impact printer of the dot matrix type is shown to comprise a printhead means comprising a printhead 10 which is supported for transport adjacent a platen 12 on a track comprising a machined rod 14. The rod 14 is spaced in a transverse direction from the platen and extends in a direction parallel to a longitudinal axis 16 of the platen. Positioned between the head 10 and the platen 12 are a record medium comprising an edge perforated elongated, sheet 18 and an inked print ribbon 20. Conventional cog wheels, not shown, engage the edge perforations 19 and provide for stepped advancement of the sheet 18 in the direction of the arrow 21. The printhead 10 is alternately transported along the track 14 in directions represented by arrows 22 and 23 parallel to the platen 12. It is advanced by a gear belt 24 which is formed of an elastomeric material. The gear belt 24 is coupled to the head 10 and extends about a drive capstan 25 and an idler pully 26. Rotating motion is imparted to the capstan 25 by a drive shaft 28 of a servo motor 30. An encoder disk 32, described more fully hereinafter, is mounted on the drive shaft 28 for rotation therewith. As the gear belt 24 which is mechanically coupled to the printhead 10 and to the capstan 25 is rotated, the head 10 will be advanced along the rod 14 in directions indicated by the arrows 22 and 23, depending upon the direction of rotation of the drive shaft 28. The printing wires in head 10 will be actuated in a direction transverse to the platen axis 16 as the head is advanced in the direction of the arrow 23. This transverse actuation causes printing of character dots. Similarly, the printing wires in head 10 will also be transversely actuated when the head is advanced in the direction of the arrow 22 so that printing occurs when the head is transported in either direction.

The printhead 10 includes a vertically aligned array of print wires which is referred-to generally in FIG. 1 by the reference numeral 34. Each of the print wires of the array is selectively, electromagnetically energized by an associated solenoid winding, not illustrated. A print wire advances in a transverse direction with respect to the axis 16 of the platen and a leading segment of the print wire impacts the ribbon 20, the sheet 18 and the platen 12. Impact causes printing of an inked area corresponding to a face of the forward wire segment. One or more of the print wires are selectively energized to print character dots of a single matrix colum. The head 10 is advanced incrementally or continuously and during the advancement, the array of print wires are selectively energized to form one or more dots at successive dot matrix columns thereby forming a dot matrix character.

There is illustrated in FIG. 3 a segment of a print line which is scanned by the array 34 of wires of the printhead means 10 during advancement in a direction indicated by the arrow 23 parallel to the platen 12. The array of wires 34 comprises seven vertically aligned wires each one of which prints along one of the rows 50–62 during head advancement. Printing is alternatively incremental or continuous. During incremental printing, the head is moved past successive predetermined column locations 64–104. During continuous printing, the head is continuously advanced past each of these predetermined column locations. In either case, when the vertical array of print wires 34 is aligned with a predetermined column location, it is desired that the head selectively print dots in one or more of the rows 50–62 in accordance with a predetermined code for the character being produced. The printhead 10 will continue to scan successive columns and to print characters in dot matrix form as it advances parallel to the platen.

Figure 4:
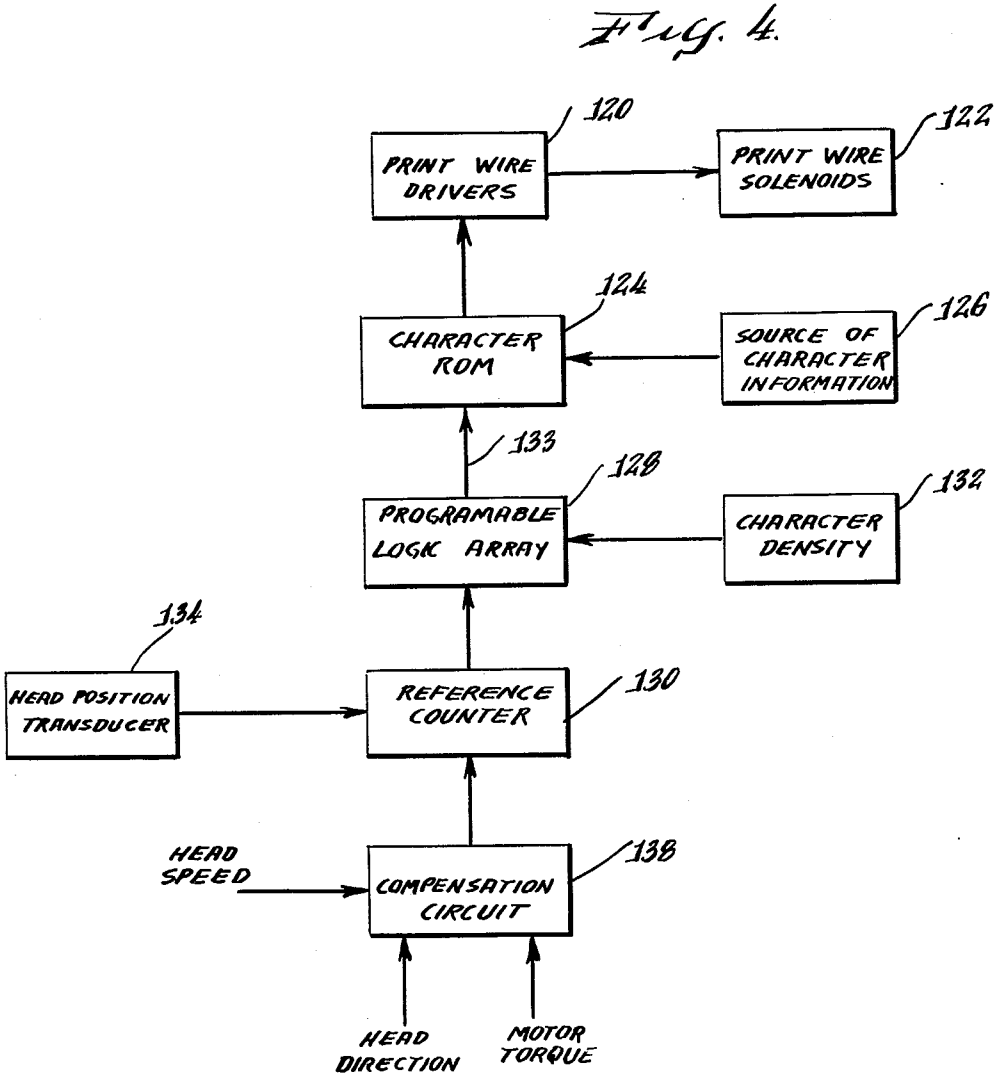
FIG. 4 is a block diagram of a circuit arrangement constructed in accordance with features of the invention; and, FIG. 5 is a schematic diagram of a circuit arrangement, partly in block form, for compensating for delays for displacement of a printhead means.
Figure 2:
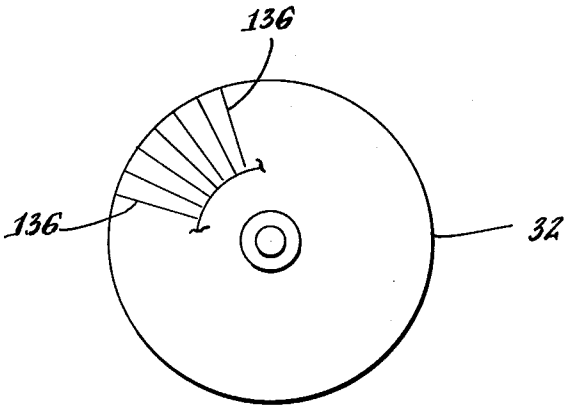
FIG. 2 is a diagram illustrating an encoder disc used with the printer of FIG. 1.

There has been provided in prior art arrangements a means for predetermining the location of these matrix columns and for monitoring the position of the printhead 10 in order to correlate the printing of a dot matrix character with predetermined locations. However, as indicated hereinbefore, various physical factors can operate to cause the printed dot to be laterally displaced from the predetermined column location. For example, in printing the column 76 the column dots, because of these characteristics, are actually printed, at times, between the columns 76 and 78. FIG. 4 is a block diagram of a circuit arrangement for monitoring the position of the advancing printhead as it travels in the direction 23 (FIG. 3) and for compensating for the physical factors enumerated hereinbefore which can result in a printed dot being displaced from the desired dot matrix column location. A head wire actuating means for accelerating the print head wire in a transverse direction toward the platen at predetermined matrix column locations is provided and includes print wire driver circuit means 120 which is coupled to the print wire solenoids 122. As indicated hereinbefore, each of the print wires is electromagnetically energized for acceleration toward the platen by an associated solenoid. In the vertical array of print wires 34, each of the seven print wires includes an associated solenoid. The solenoids in any one matrix column location are selectively energized by information derived from a character Read Only Memory (ROM) 124. One such exemplary ROM comprises ROM-S8564 available from American Micro Systems, Inc. The ROM 124 stores the dot matrix format for each of the plurality of characters which can be formed by the printer. Each stored character has a 9 column dot format. This ROM is addressed by a character code such as the standard ASCII code which is derived from a source of character information 126 comprising a communication or data line or a keyboard for the printer. The ROM 124 is also addressed by matrix column address information derived from a programmable logic array 128. The ASCII code selects the particular character which is to be printed while the column address information from the programmable logic array indicates the particular matrix column to be printed. The output of the character ROM 124 therefore provides information to the print wire drivers 120 with respect to those wires which are to be energized at a predetermined matrix column location.

Character printing density is provided at a routinely used density, such as 10 characters per inch, or the character can be compressed to provide greater densities such as 13, 15 and 16.5 characters per inch. When operating at compressed densities, the predetermined dot matrix column locations for the compressed characters are shifted relative to the locations at lower densities. A programmable logic array 128 is provided for selecting the predetermined matrix column locations at each of the character densities. This programmable logic array comprises a transistor matrix. Inputs are provided to the array 128 from a reference counter 130 and from a character density signal source 132 which comprises an operator selector panel or a data line. In one arrangement the counter 130 counts to a modulus of 66 for each of the characters of the smallest character density and to a corresponding lesser modulus for characters of greater density. The matrix of logic array 128 enables output lines 133 representing dot matrix column locations for the selected character density. The enabled output lines 133 apply this dot matrix column location information to the ROM 124 for addressing particular column locations for a selected character. This technique for character compression is described more fully and is claimed in a copending U.S. patent application of C. M. Jones and W. A. Surber Ser. No. 847,585 filed concurrently herewith, the disclosure of which is incorporated herein by reference and which application is assigned to the assignee of this invention.

Reference counter 130 monitors the position of the print head means 10. As described in greater detail hereinafter, input signals to the reference counter for stepping the counter by incrementing or decrementing the counter are derived from a head position transducer 134 which includes the encoder disc 32. The disc 32 includes indicia comprising a plurality of radially extending indicia 136 for generating position reference signals. As the printhead 10 is scanned along the platen, the counter 130 is continuously incremented by these signals and the increments represent possible dot matrix column locations as well as positional locations intermediate the dot matrix column locations. The indicia 136 are formed to a relatively high resolution so that a plurality of intermediate location signals are generated. The position of the printhead is thereby monitored as a result of the signals generated from the disc and these signals are utilized to provide indications of matrix column locations for the printing of the matrix column characters.

The printing head wire displacement during the flight time and other printing head displacements resulting from characteristics of the printer are compensated for by a circuit means 138 which supplies compensating incrementing or decrementing signals to the counter 130. The compensation circuit means 138 applies a compensating incrementing or decrementing signal to the counter 130 in accordance with information supplied thereto from circuit means which sense movement of the head 10. A compensating count is applied to the counter 130 in order to initiate or retard actuation of the print head wires at an earlier or delayed position so as to cause the printhead wires to print the desired character dots in the predetermined dot matrix column. For example, referring to FIG. 3, if character dots are to be printed in matrix dot column 76 and the physical factors enumerated hereinbefore operated to cause a displacement so that in an uncompensated situation the dots would be actually printed between columns 76 and 78 of FIG. 3, then the compensating circuit means 138 applies an incrementing count to the counter 130 for initiating printing at a location preceeding the matrix column location 76 by a distance sufficient to assure that the actual printing occurs at the column 76.

Figure 5:
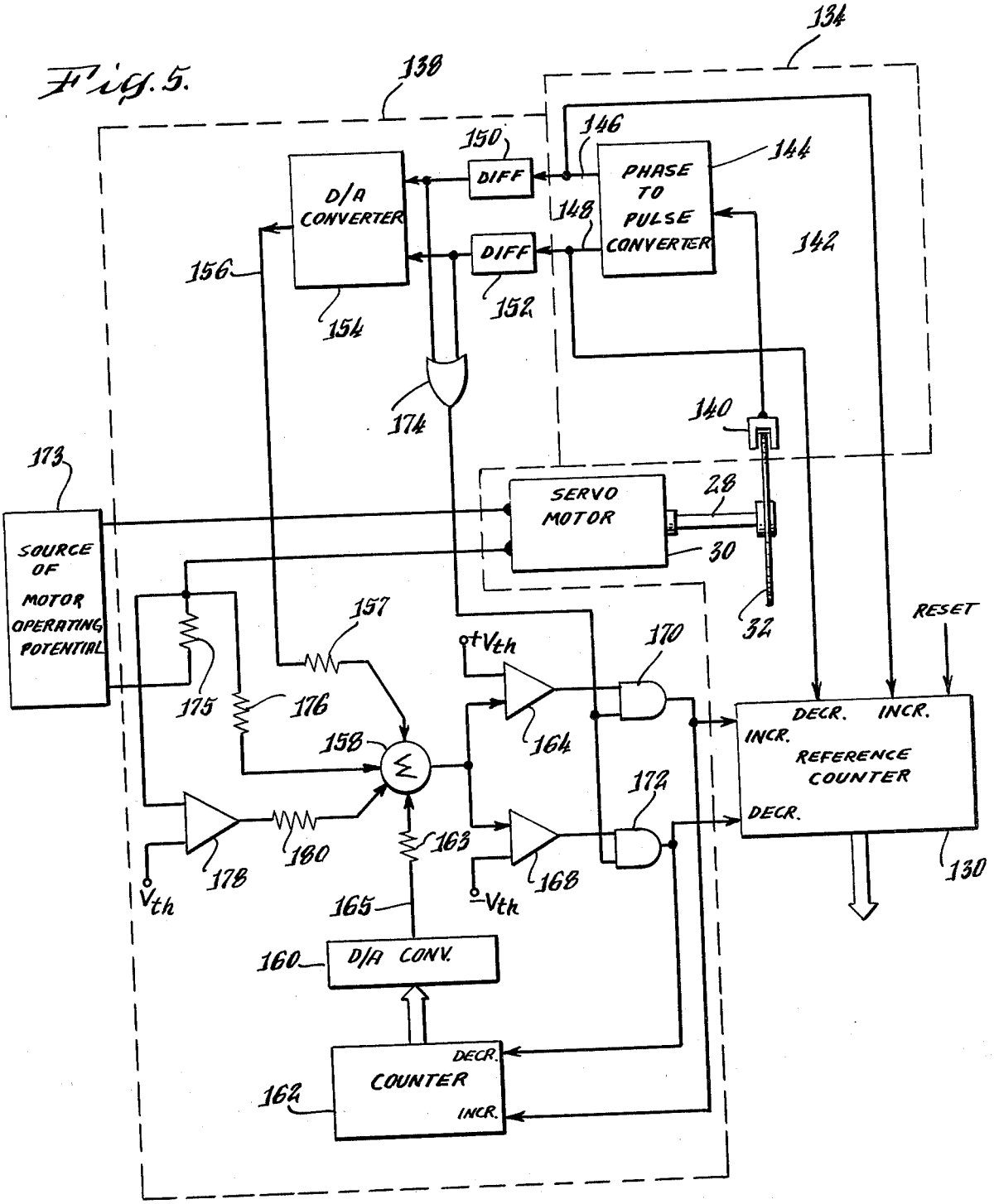

There is illustrated in FIG. 5 a more detailed representation of the head position transducing means 134, the compensation circuit means 138 and compensating signal sources. The head position transducer 134 which is represented within the dashed rectangle 134 in FIG. 5 includes a U-shaped transducer body 140 which houses a light and photo detector means. The light is positioned in the housing adjacent one surface of the disc 32 and first and second photo-detector cells are positioned opposite the light source, adjacent an opposite surface of the disc 32. The photo detectors are spaced apart in a circumferential direction by a finite number of indicia 136 plus ¼ slit. The projection of light from the source through the indicia 136 during rotation of the disc 32 results in the generation of quadrature related first and second signals by the first and second detectors, respectively. The disk 32 can rotate in a clockwise or counterclockwise direction, depending upon the direction of scanning of the printhead. The generation of quadrature related signals provides signal information from which the direction of rotation of the disk 32 can be determined. These quadrature related signals are coupled via line 142 to a pulse shaping and phase discriminating circuit arrangement 144. This pulse shaping and phase discriminating circuit arrangement provides output pulses on a line 146 representative of clockwise rotation, for example, of the disk 32 and output pulses on a line 148 representative of counterclockwise rotation of the disk 32. These pulses are applied to and step the reference counter 130.

Reference counter means 130 comprises a bit-directional binary counter adapted to be incremented or decremented by pulses from the head position transducer and to be incremented or decremented by pulses from the compensation circuit 138. As indicated hereinbefore, the dot matrix characters can be printed at different character densities, resulting in different character widths for the same character. In an exemplary arrangement which is not deemed limiting in any respect, the indicia 136 of disk 32 are formed with a resolution which will provide 660 pulses for each linear inch of head travel. When printing at a character density of ten characters per inch, there is thus provided 66 reference signals representing 66 possible locations for locating nine matrix dot columns. At the density of ten characters per inch, adjacent matrix dot print columns are separated by 5 intermediate positions and the remaining positions are utilized to establish spacing between the desired printing characters. At ten characters per inch then, the reference counter 130 will have a modulus of 66. When the disk 32 is rotating in a clockwise direction, the counter input signals on line 146 will cause the counter to increment during 66 pulses after which period of time, the counter is reset to recount this modulus. When the disk 32 is rotating in a counter clockwise direction, the pulses on line 148 will cause the counter to decrement or step down a similar number of counts. Were the system not to exhibit the flight time and other mechanical characteristic displacements referred to hereinbefore, the desired matrix column printing would occur for example on count 1, 6, and each successive 5 counts up through an accumulated count of 41. However, the flight time characteristic and the other mechanical delay characteristics will in actuality cause the matrix column to be printed at a displaced location intermediate to a dot matrix column at the desired five unit increments.

The compensation circuit means 138, represented by the dashed rectangle 138 in FIG. 5, senses the occurrence of these characteristics and automatically varies the accumulated count in the reference counter 130 by increasing or decreasing the count. The count is varied by a number of counts equivalent to the delays encountered thereby providing that a dot matrix column is actually printed at the predetermined five unit increments. The compensation circuit means includes circuit means for compensating for movement of the head. Flight time displacement is proportional to the speed of the advancing head and this circuit means generates an electrical signal representative of head speed. This circuit means comprises differentiators 150 and 152 and a digital analog converter 154. The pulse signals provided on the lines 146 and 148 are applied to the differentiators 150 and 152. The differentiator outputs comprise pulses of substantially constant width and having a frequency which varies with the rotation rate of the disc 32 and thus the linear speed of the head 10. These signals are applied to the converter 154 which provides on an output line 156 a DC analog current signal having an amplitude proportional to the speed of the head 10 and a polarity representative of the direction of movement of the head. A voltage proportional to this analog current is developed across impedance 157 which is summed at a summation point 158 with a signal from a digital to analog converter 160. A digital input to the converter 160 is provided from a bidirectional binary counter 162. The summation point 158 is coupled to comparators 164 and 168 along with threshold reference voltages $+V_{th}-V_{th}$ respectively. As indicated hereinafter, the converter 160 provides a bucking signal via an impedance 163 over a line 165 which causes a null from the comparators 164 and 168 when its amplitude is equal to that of the output of the converter 154. Outputs from the comparators 164 and 168 are applied to AND gates 170 and 172, respectively. An additional input to the AND gates 170 and 172 comprises a pulse from the OR gate 174, the inputs to which are derived from the differentiators 150 and 152. The absence of a null at the junction 158 will enable the comparator 164 or the comparator 168, depending on polarity. The alternatively enabled AND gates 170 and 172 are pulsed at a rate determined by the frequency of output pulses from the OR gate 174. Since this frequency is proportional to the speed of the head 10, these pulses will cause the reference counter 130 to increment or decrement accordingly. In compensating for flight time variations, the reference counter 130 is incremented or decremented by a count which is proportional to the speed of the head. The incrementing or decrementing will occur during acceleration to a peak speed or deceleration therefrom. However, when the head has attained and is traveling at a constant desired speed, the incrementing or decrementing is interrupted, since the reference counter 130 now has been stepped sufficiently to compensate for this velocity.

A circuit means is provided for quantizing the speed and for providing an analog signal for comparison with the analog speed signal of converter 154. The circuit means comprises the binary counter 162 and the digital analog converter 160. Output pulses of the AND gates 170 and 172 are applied to the counter 162 incrementing or decrementing this counter while the binary output from the counter is applied to the converter 160 which generates a DC analog signal proportional to the quantized value of speed. This signal is applied by the line 165 to the summing junction 158 for cancelling the output of the converter 154.

In operation, the quantizing counter 162 stores a neutral count representing zero speed of the head 10. This neutral count will generate an output from the converter 160 which cancels an equivalent analog output from the converter 154 for the zero speed condition. As the head 10 accelerates from a stationary position to a peak speed, pulses of varying frequency will occur at the output of OR gate 174 and counter stepping pulses will alternatively occur at the output of gates 170 and 172. These pulses will also increment or decrement both the reference counter 130 and the quantizing counter 162. Stepping of the counter 162 lags slightly behind the output variations of the converter 154 and thus does not inhibit the comparators 164 or 168 until such time as the head 10 attains a constant speed. When a constant speed is attained, the output amplitude from the converter 154 stabilizes and the counter 162 will establish a null at the summing junction 158. This null will be maintained until further variations in speed are encountered. When the head decelerates from this constant speed, the output amplitude from the converter 154 will change, a null will no longer exist at the summing junction 158 and the AND gates 170 or 172 will alternatively cause the counters 130 and 162 to decrement or increment. The counter 162 will follow the variation in output amplitude of the converter 154 until such time as the output of the converter 154 stabilizes. A null will then be established at the summing junction 158. At this time, the gates 170 and 172 will be disabled and further incrementing or decrementing of the counter 130 is inhibited. Thus, the count in the reference counter 130 is varied in order to compensate for head movement and particularly flight time displacement.

Circuit means are also provided for generating a signal proportional to mechanical non-compliance factors occurring in the head drive systems, such as spring factors. The non-compliance is proportional to servo-motor torque. Servo-motor torque is, in turn, proportional to servo-motor drive current. In FIG. 5, a source of servo-motor drive current 173 is provided. A voltage proportional to current is developed across a shunt impedance 175. This voltage which is proportional to servo-motor current is also proportional to servo-motor torque. The voltage is applied via a summation resistor 176 to the summation point 158. The signal which is characteristic of non-compliance in the system is applied separately with the signal from comparator 160 or it is combined with the speed signal of the converter 154 and the signal from the converter 160 to offset or cumulate with these signals, depending upon polarity.

As indicated hereinbefore, mechanical cocking of the head can result in a drag and thus a displacement in the printed dot matrix column. Cocking is a characteristic which occurs during acceleration and deceleration and will have a positive or negative sense depending upon the direction of acceleration. A circuit means is provided for generating a signal indicative of the cocking. The voltage at the current shunt 175 is also applied to a comparator 178 which is polarity senstive and which provides an output indication representative of the direction of acceleration of the printhead 10. This indication is also applied by a summation resistor 180 to the summation point 158, either separately with the signal from the convertor 160, or cumulatively with the speed and compliance signals.

There has thus been described an improved impact printer wherein means are provided for compensating for dot matrix column printing displacement caused by head movements. Compensation is made for wire flight time and for other mechanical characteristics including noncompliance in the drive system and mechanical cocking thereby reducing misregistration in the printed material.

While there has been described a particular embodiment of the invention, it will be apparent to those skilled in the art that variations can be made thereto without departing from the spirit of the invention and the scope of the appended claims.

What is claimed is:

1. An improved printer comprising an elongated printing platen having a longitudinal axis thereof, a head means carrying printing elements for printing characters, transport means for advancing said head means in a lateral direction parallel to the longitudinal axis of said platen, first means for detecting the position of said head means to provide position signals, actuating means responsive to said first detecting means for initiating and causing the acceleration of said printing elements in a direction toward the platen at selected ones of predetermined print locations, second means for detecting signals representative of undesirable lateral displacement of said head means with respect to such selected predetermined print locations, and compensating means responsive to said second detecting means for offsetting the locations for the initiation of actuation of said printing elements for compensating for such undesirable lateral displacement of said head means, said actuating means comprising a reference counter, means for applying said position signals to said counter for stepping said counter through a plurality of different counts at selected one of which actuation of the head means is initiated, said compensating means varying the count of said reference counter in response to said detected signals representing undesirable lateral displacement of said head means, said compensating circuit means comprising means for deriving analog velocity signals from said position signals, said analog velocity signals having an amplitude which are proportional to the speed of said head means and a polarity which defines the direction of lateral movement of said head means.

2. The printer of claim 1 wherein said compensating circuit means includes means for enabling variation in a count in said counter when the speed of lateral movement of said head means varies and for disabling variation in a count when said speed is substantially uniform.

3. The printer of claim 2 wherein said enabling and disabling means includes circuit means for providing a second analog signal representative of the variation of said reference count.

4. The printer of claim 3 wherein said means for providing said second analog signal includes a second counter means applying a stepping signal to said counter when the speed of lateral head means movement is varying, and means coupled to said second counter for providing an analog signal having a magnitude and polarity representative of the accumulated count of said second counter.

5. The printer of claim 4 wherein said enabling and disabling means includes circuit means for summing said analog speed signal and said second analog signal and for providing a null signal, coincidence circuit means, means applying said null signal and said position reference signal to said coincidence circuit means for generating an output therefrom upon coincidence of the absence of a null signal and occurrence of said position reference signal, and means applying an output signal from said coincidence circuit to said reference counter and said second counter for varying the count of said reference counter and for stepping said second counter.

6. The printer of claim 1 wherein said transport means exhibits mechanical noncompliance between initiation of lateral movement of said head and movement thereof and said compensating circuit means varies a count in said reference counter in response to a magnitude of said non-compliance.

7. The printer of claim 1 wherein said transport means exhibits a spring factor and said count is varied in response to said spring factor.

8. The printer of claim 6 wherein said transport means includes a drive motor having an output shaft providing a torque, means coupling said drive shaft to said head means for causing lateral movement thereof, said coupling means exhibiting a spring factor which causes said mechanical noncompliance, means for supplying an drive current to said drive motor, said drive current having an amplitude which is proportional to said shaft torque and means for deriving a signal from said exciting current for varying a count of said reference counter to response to the amplitude thereof for compensating for mechanical noncompliance.

9. The printer of claim 7 wherein said coupling means comprise an elastomeric drive belt.

10. An improved printer comprising an elongated printing platen having a longitudinal axis thereof, a head means carrying printing elements for printing characters, transport means for advancing said head along a support track in a lateral direction parallel to the longitudinal axis of said platen, first means for detecting the position of said head means to provide position signals, actuating means responsive to said first detecting means for initiating and causing the acceleration of said printing elements in a direction toward the platen at selected ones of predetermined print locations, second means for detecting signals representative of undesirable lateral displacement of said head means with respect to such selected predetermined print locations, and compensating means responsive to said second detecting means for offsetting the locations for the initiation of actuation of said printing elements for compensating for such undesirable lateral displacement of said head means, said actuating means comprising a reference counter, means for applying said position signals to said reference counter for stepping said counter through a plurality of different counts at selected ones of which actuation of the head means is initiated, said compensating means varying the count of said reference counter in response to said detected signals representing undesirable lateral displacement of said head means, said head means exhibiting mechanical cocking between said head and said support track, said transport means comprising a drive motor having a drive shaft, means for supplying a drive current to said drive motor, said drive current having a polarity indicative of the direction of the applied torque on said drive shaft, said compensating means comprising means for deriving a signal indicative of the polarity of said drive current, and means for varying said count of said reference counter in accordance with the polarity indicated by said last named signal for compensating for mechanical cocking.

11. An improved printer comprising an elongated printing platen having a longitudinal axis thereof, a head means carrying printing elements for printing characters, transport means for advancing said head means in a lateral direction parallel to the longitudinal axis of said platen, first means for producing pulses representative of a count value indicative of the position of said head means with respect to predetermined print locations, actuating means responsive to said first producing means for initiating and causing the acceleration of said printing elements in a direction toward the platen at selected ones of said predetermined print locations, second means for detecting signals representative of variable undesirable lateral displacements of said head means with respect to said selected ones of said predetermined print locations, and compensating means responsive to said second detecting means for providing additional pulses representative of a count value indicative of a spatial offset to said position of said head means with respect to said predetermined print locations for the initiation of actuation of said printing elements to compensate for such undesirable lateral displacements of said head means.

12. A matrix printer for producing characters on a record medium comprising a print head, drive means for moving said head along a line on said record medium, said print head comprising actuable printing elements, first means for generating a plurality of incremental position signals representative of the movement of said head, the number of position signals per character being greater than the maximum number of matrix column positions available to make up a character, a print control counter responsive to said incremental position signals for controlling the print line location where the actuation of said printing elements is effected, means for detecting signals representing undesirable lateral displacements of said head for generating additional signals, said print control counter responsive to said additional signals for changing the print line location where the actuation of said printing elements is effected.

13. An arrangement according to claim 12 wherein said means for detecting comprises means responsive to the speed of head movement for generating additional signals.

14. An arrangement according to claim 13 wherein said means for detecting comprises means differentiating said position signals to generate said last named signals.

15. An arrangement according to claim 12 wherein said means for detecting comprises means responsive to a signal representative of the acceleration of head movement for generating additional signals.

16. An arrangement according to claim 15 wherein said drive means comprises a motor, and said means for detecting comprises means responsive to motor drive current for generating said additional signals.

17. An arrangement according to claim 12 wherein said means for detecting comprises means responsive to a signal representative of the polarity of acceleration of head movement for generating additional signals.

18. An arrangement according to claim 17 wherein said drive means comprises a motor, and said means for detecting comprises means responsive to changes in polarity of motor drive current for generating said additional signals.

19. In a matrix printer comprising an elongated printing platen having a longitudinal axis thereof extending along a record medium, a print head carrying printing elements for printing characters on said record medium, drive means comprising a motor for advancing said head along the longitudinal axis of said platen, control means comprising a position transducer coupled to said drive means for providing incremental position signals representative of matrix columns and inter-matrix columns, a reversible counter for dividing said position signals for controlling activating of said printing elements to produce component character marks at matrix column locations as said head advances along said platen, means for detecting signals representative of undesirable lateral displacement of said head with respect to such column locations to provide additional incremental position signals, and compensating means responsive to said additional incremental signals and coupled to said control means for modifying the count of said reversible counter for offsetting the location for the activating of said printing elements for compensating for such undesirable lateral displacement of said head means.

20. Printer control apparatus adapted for operation with a printer of the serial dot matrix character printing type in which a printing head having selectively actuable matrix printing elements moves along the line to be printed, comprising a sensor for providing output pulses indicative of such head movement, a print control counter responsive to sensor output pulses for controlling the print line locations where the actuating of printing elements is effected, the available number of sensor output pulses per character being greater than the maximum number of matrix element positions available to make up a character, and compensating means responsive to signals representative of the mechanical actuation characteristics of the motion of said printing head along said print line for applying additional pulses to said control counter.

21. Printer control apparatus according to claim 20 wherein said compensating means supplies pulses controlled by the print head velocity along said print line.

22. Printer control apparatus according to claim 20 wherein said compensating means supplies pulses controlled by the print head acceleration along said print line.

23. Printer control apparatus according to claim 20 wherein said print head movement is produced by a motor operating through a drive train and said compensating means supplies pulses corresponding to motor torque.

24. Printer control apparatus according to claim 21 wherein printing is carried out during movement of said printing head during both directions of movement of said printing head along said print line and said pulses supplied by said compensating means increment the content of said control counter during one direction of movement and decrement the content of said control counter during the other direction of movement.

25. Printer control apparatus according to claim 20 wherein said compensating means includes a compensating counter, means for developing an analog signal corresponding to direction and velocity of head movement, a summing point, means for applying said analog signal to said summing point, first and second compensating gates each having an input connected with a pulse source, means connecting an input of each of said compensating gates with said summing point, means connecting the outputs of said gates with said control counter and with said compensating counter, means for converting count indications of said compensating counter to analog signals, and means for applying said analog signals to said summing point.

26. Printer control apparatus according to claim 25 wherein head movement is produced by a motor operating through a drive train, means for developing analog signals corresponding to motor torque, and means for applying said last named signals to said summing point.

27. Printer control apparatus adapted for operation with a printer of the serial dot matrix character printing type in which a printing head carries matrix printing elements which are selectively actuable toward a platen to effect printing during movement of said head in a direction parallel to the longitudinal axis of the platen comprising a source of first pulses indicative of such head movement, a print control counter responsive to said first pulses for producing signals for controlling the actuation of said printing elements toward said platen at predetermined print locations, said first pulses dimensioned to provide an available number of uniformly spaced first pulses per character which is greater than the maximum number of matrix element positions available to make up a character, a source of second pulses representative of undesirable lateral displacement of said head with respect to such predetermined print locations, and means for offsetting the location for the actuation of said printing elements for compensating for such undesirable lateral displacement of said head comprising means for applying said second pulses to said counter for changing the count of said print control counter.

* * * * *

UNITED STATES PATENT OFFICE

CERTIFICATE OF CORRECTION

Patent No. 4,210,404 Dated July 1, 1980

Inventor(s) William A. Hanger

It is certified that error appears in the above-identified patent and that said Letters Patent are hereby corrected as shown below:

Column 2, line 64, cancel "printing" and insert -- print --
Column 6, line 19, cancel "head"
Column 7, line 43, cancel "138"
Column 11, line 6, Claim 10, after "head" insert -- means --

Signed and Sealed this

*Twenty-eighth* Day of *July 1981*

[SEAL]

*Attest:*

GERALD J. MOSSINGHOFF

*Attesting Officer* *Commissioner of Patents and Trademarks*